United States Patent [19]

Bryan, Jr.

[11] Patent Number: 4,698,723

[45] Date of Patent: Oct. 6, 1987

[54] LIGHTNING DISCHARGE PROTECTION ROD

[75] Inventor: Charles F. Bryan, Jr., Poquoson, Va.

[73] Assignee: The United States of America as represented by the Administrator of the National Aeronautics and Space Administration, Washington, D.C.

[21] Appl. No.: 855,983

[22] Filed: Apr. 24, 1986

[51] Int. Cl.[4] ..... H05F 3/00

[52] U.S. Cl. ..... 361/218; 361/222

[58] Field of Search ..... 361/212, 220, 223, 216–218, 361/222; 244/1 A; 338/225, 250; 174/2, 3

[56] References Cited

U.S. PATENT DOCUMENTS

| | | | |
|---|---|---|---|
| 2,497,924 | 2/1950 | Beach | 361/222 X |
| 3,170,087 | 2/1965 | Tanner et al. | 361/222 |
| 3,480,231 | 11/1969 | Lumn . | |
| 3,767,971 | 10/1973 | Patrick | 361/222 |
| 3,898,526 | 8/1975 | Hendricks | 361/222 |
| 3,906,308 | 9/1975 | Amason et al. . | |
| 3,989,984 | 11/1976 | Amason et al. . | |
| 4,093,978 | 6/1978 | Plumer, Jr. . | |
| 4,246,624 | 1/1981 | Lazelle . | |
| 4,262,321 | 4/1981 | Cline | 361/223 X |
| 4,382,049 | 5/1983 | Hofmeister et al. . | |
| 4,398,234 | 8/1983 | Brick et al. | 361/222 X |
| 4,445,161 | 4/1984 | Brick . | |
| 4,502,092 | 2/1985 | Bannink, Jr. et al. . | |
| 4,506,311 | 3/1985 | Cline . | |
| 4,522,889 | 6/1985 | Ebneth et al. . | |

FOREIGN PATENT DOCUMENTS

| | | | |
|---|---|---|---|
| 690379 | 4/1953 | United Kingdom | 361/218 |

*Primary Examiner*—Donald A. Griffin

*Attorney, Agent, or Firm*—George F. Helfrich; John R. Manning

[57] ABSTRACT

This invention relates to a system for protecting an in-air vehicle from damage due to the craft sustaining a lightning strike. It is an extremely simple device consisting of a sacrificial graphite composite rod 40, approximately the diameter of a pencil with a length of about five inches. The sacrificial rod 40 is constructed with the graphite fibers running axially within the rod in a manner that best provides a path of conduction axially from the trailing edge of an aircraft to the trailing end of the rod. Sacrificial rod 40 is inserted into an attachment hole 32, machined into trailing edges of aircraft flight surfaces, such as vertical fin cap 31, and attached with adhesive in a manner not prohibiting the conduction path between the rod 40 and aircraft 10. The trailing end of rod 40 may be tapered for aerodynamic and esthetic requirements. This rod is sacrificial but has the capability to sustain several lightning strikes and still provide protection.

7 Claims, 3 Drawing Figures

LIGHTNING DISCHARGE PROTECTION ROD

ORIGIN OF THE INVENTION

The invention described herein was made by an employee of the United States Government and may be manufactured and used by or for the Government for governmental purposes without the payment of any royalties thereon or therefor.

BACKGROUND OF THE INVENTION

This invention relates to the field of lightning protective systems. More particularly, the invention is oriented toward a protective rod discharging electrostatic charges from an aircraft sustaining a lightning strike in-flight. Applications include all types of in-atmosphere craft including military and civilian aircraft as well as earth launched space bound vehicles. The invention has utility in protecting any vehicle suffering a lightning strike where the vehicle and interior equipment cannot be grounded to earth.

Lightning strikes on airborne vehicles are common, especially on aircraft operating at low flight levels such as commercial commuter aircraft and military surveillance and anti-submarine aircraft. The field of aircraft lightning protection and design includes insulators to protect internal electronics, flight control systems and fuel cells, as well as various conductive devices to route the electrical charges away from sensitive areas to heavy structural components comprising aircraft ground.

Lightning strikes and their characteristics have been studied by the National Aeronautics and Space Administration at Langley Research Center for several years. The lightning study project employs an F-106B aircraft specially configured to attract and study lightning strikes. This project has evaluated several hundred in-flight lightning strikes and test results indicate that aircraft lightning damage to aircraft varies depending upon the zone of the aircraft sustaining the strike. Those skilled in the art of lightning strike phenomena study generally divide the aircraft in three zones. Zone one includes areas generally attracting the strike, zone two, the areas on the surface of the aircraft where a high probability exists that the lightning strike will be swept rearward from the attachment point due to the forward momentum of the vehicle and zone three, those areas remaining. The lightning itself is also considered by convention to be categorized into three distinct phases. The prestrike phase where a stepped leader of electrostatic lightning charge is attracted to an attachment point on the aircraft such as the wing tip, nose cone or other salient aircraft projection. When this occurs, the aircraft becomes part of the stepped leader and the stepped leader leaves the aircraft generally in the vicinity of the trailing edges, on its journey to contact earth.

Immediately upon the stepped leader contacting earth a return stroke of extremely high electrical charge transits from earth back to the cloud through the aircraft. This phase is generally referred to as the restrike phase and the lightning restrike return stroke may be as high as 0.2 mega-amps. This lightning restrike is capable of considerable damage to trailing edges and attachment points on an aircraft.

Aircraft with the modern metal and organic matrix composite wings, tails and other control surfaces often sustain heavy damage during this phase of a lightning strike. The damage often takes the form of delamination and/or holes completely burned through the structural surfaces. In some instances considerable loss of matrix material and sometimes complete loss of a static discharge wick in the area of the strike is encountered. In some instances the reinforcing material forming the infrastructure of the area sustaining the strike is disintegrated.

The third phase is a heavy coulomb phase which follows the restrike phase. It is of longer duration and builds up a high coulomb charge. It is also interesting to note that the forward movement of the aircraft tends to move the craft forward out of the lightning channel, forcing the area of the aircraft making the connection to the cloud to sweep back toward the trailing edges of the aircraft. The trailing edges, however, are in the direct conduction path during all three phases of a lightning strike. Consequently, these areas sustain most of the physical damage when an aircraft suffers a lightning strike.

Many devices exist to insulate zone one aircraft parts from becoming an attachment point for the stepped leaders. Other conducting devices such as graphite strips on an aircraft nose cone channel the stepped leader to heavy aircraft structures to minimize damage. Likewise many insulating devices and coatings are employed in zone two of an aircraft to protect interior components from the swept-stroke damage. The zone three areas, unfortunately, lack protecting devices and due to the strike phenomena described above sustain damage during both the stepped leader and restrike phases. Consequently, damage in the form of material decomposition or atomization often occurs on the trailing edges of in-atmospheric craft. This destruction is exacerbated with the relatively non-conducting modern matrix composites.

Accordingly, it is an object of this invention to provide a means of discharging the electrostatic charge passing through the trailing edges of an aircraft, avoiding damage to the vehicle.

Another object of the present invention is to provide protection of trailing edges of an aircraft that can provide protection during all phases of an aircraft lightning strike.

Another object of the present invention is to provide a lightning discharge protection rod that is capable of sustaining multiple lightning strikes while continuing to impart protection.

Yet another object of the present invention is to provide a means of protecting an aircraft from lightning damage that is simple to manufacture and install.

Still another object of the present invention is to provide a means of protecting an aircraft from lightning strike damage in-flight that is inexpensive to manufacture and install.

A further object of the present invention is to provide a means of protection to aircraft parts manufactured from composite materials.

Still another object of the present invention is to provide lightning protection to aircraft parts constructed from organic composites.

STATEMENT OF THE INVENTION

According to the present invention the foregoing and additional objects are attained by incorporating a lightning discharge rod to the trailing edges of an aircraft resulting in the protection rod sacrificially sustaining the damage otherwise occurring from in-flight lightning strikes.

The invention is accomplished by affixing a "pencil" shaped rod constructed out of metal matrix or organic composite material to the trailing edges of aircraft flight surfaces in such a manner that the most rearward portion of the flight surface is the composite rod. If organic composite material is used, the fibers in the matrix are formed of electrically conductive material such as boron or carbon.

The organic matrix material is manufactured with the conductive fibers oriented longitudinally in the protecting rod imparting an uninterrupted conducting path axially from one end of the rod to the other. Any metallic or conductive fiber may be employed in the construction of the composite material comprising the protection rod, such as boron or carbon, but the widespread use of carbon composites in modern aircraft construction led to utilization of this material in the fabrication and testing of the present invention. This avoids an electrical mismatch between the material of the flight surface and the lightning protection rod, as well as suggesting a supply of material available from commercial manufacturers that was inexpensive and readily available. It should be noted that the term carbon composite used herein for simplicity includes any composite material employing fibers having the properties of an electrical conductor. It should also be noted that while the optimal protection results when the protective rod and trailing edge are of uniform composition such as both constructed from carbon matrix composite material, a carbon matrix rod produces satisfactory protection to flight control surfaces formed of most organic composites.

The pencil-shaped lightning protection rod is affixed to the composite material by adhesive. A receptacle hole may be machined into the trailing edge of the aircraft flight surface, having an inside diameter conforming to the outside diameter of the protection rod. The rod is then inserted into the receiving hole on the flight surface with approximately one inch of the rod within the hole. Tolerances of the machined hole should be calibrated closely enough to place the rod in tight physical contact with the hole ensuring an effective electrical conduction path between the composite material of the flight surface and the protective rod. An adhesive is applied to approximately one-quarter inch of the rod corresponding to the rearward one-quarter inch of the machined hole in the aircraft flight surface, precluding the adhesive from insulating the forward portion of the protective rod from the flight surface.

This novel and simple device is now electrically an uninterrupted part of the aircraft extending rearward from the trailing edge of the flight surface. When the aircraft sustains a lightning strike the aircraft becomes a part of the stepped leader of the lightning charge with the charge exiting from the rear tip of the protection rod on its path earthward. The trailing position of the protection rod continues to be the portion of the aircraft in electrical contact with earth throughout all phases of the lightning strike including the destructive restrike phase when the charge returns upward toward the aircraft. This results in any material damage normally occurring to the trailing edge of the flight surface now occurring to the trailing edge of the protection rod.

Embodiments of the present invention may be employed on all trailing edges of the aircraft, operatively spaced along the wings and the vertical and horizontal stabilizers, so that protection is maximized and, independent of which aircraft section is affected, the lightning has a path through a protection rod as it traverses from the cloud to earth and back,

BRIEF DESCRIPTION OF THE DRAWINGS

A more complete appreciation of the invention and many of the attendant advantages thereof will be readily apparent as the same becomes better understood by reference to the following description when considered in connection with the accompanying drawings wherein.

DETAILED DESCRIPTION OF THE INVENTION

Figure 1:
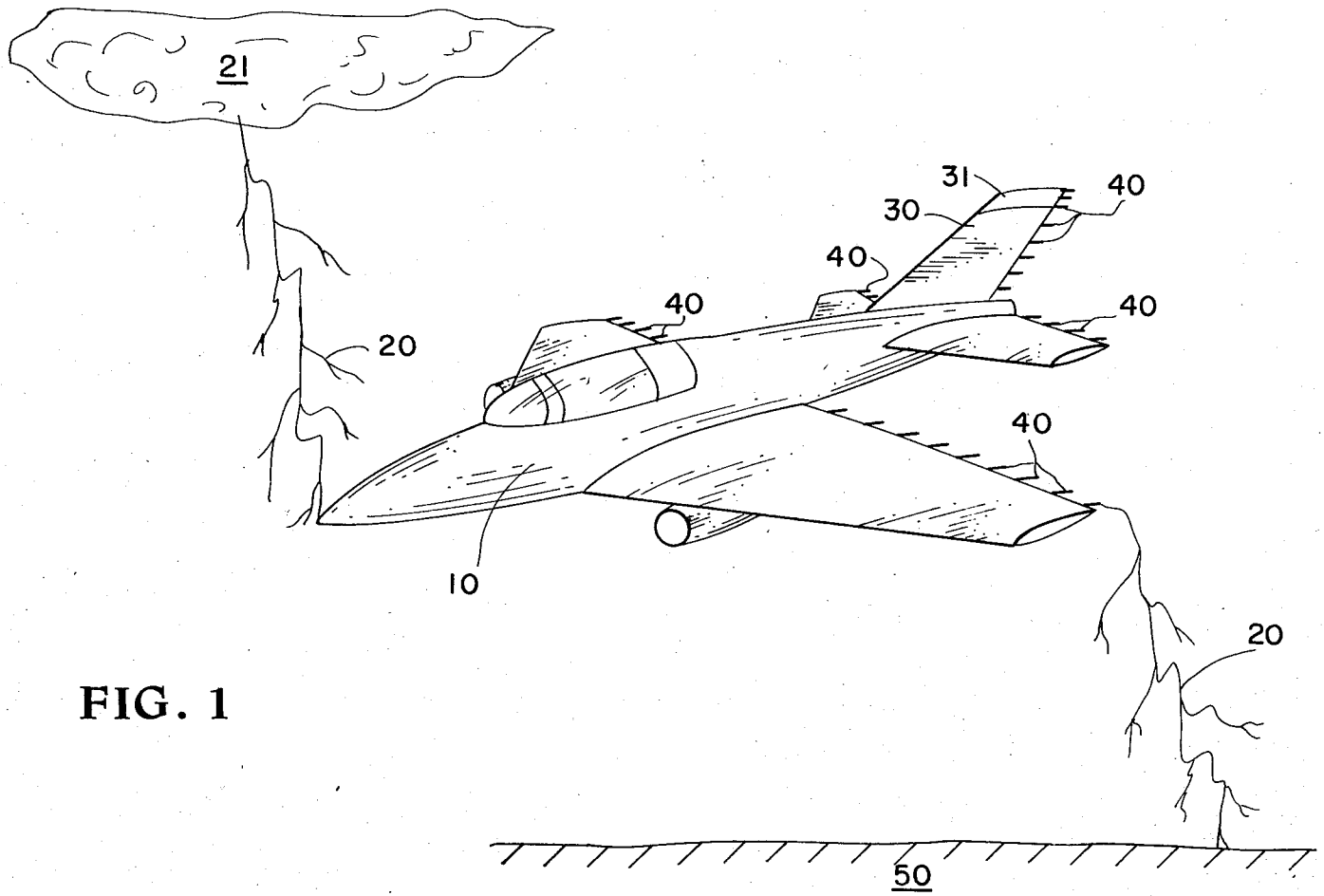
FIG. 1 is an overview perspective of an aircraft employing the present invention sustaining an in-flight lightning strike.

In describing the present embodiment of the invention illustrated in the drawings, specific terminology will be resorted to for the sake of clarity. However, it is not intended to be limited to the specific terms so selected, and it is to be understood that each specific term includes all technical equivalents which operate in a similar manner to accomplish a similar purpose. For example, the term aircraft should include all vehicles transiting the atmosphere without electrical contact with earth and the term matrix composite includes all composites employing fibers in their construction which are electrical conductors.

Turning now to the specific embodiment of the invention selected for illustration in the drawings, and referring more particularly to FIG. 1, the numeral 10 designates generally an aircraft employing the lightning protection rod of the present invention sustaining an in-flight lightning strike. As shown therein, all trailing edges of the aircraft are provided with lightning protection rods 40.

As the stepped leader of the lightning 20 exits cloud 21 on its path toward ground 50 it contacts aircraft 10 and makes aircraft 10 part of the stepped leader. The lightning charge then sweeps rearward toward the trailing edges of the aircraft surfaces into a lightning protection rod 40. The trailing edge of lightning protection rod 40 becomes the contact point as the lightning stepped leader continues it journey from the aircraft 10 to ground 50 and from ground 50 to aircraft 10 during the restrike phase. The resulting material damage to aircraft 10 is confined to the trailing edge of lightning protection rod 40, thus protecting the composite materials of the aircraft trailing edges.

Figure 2:
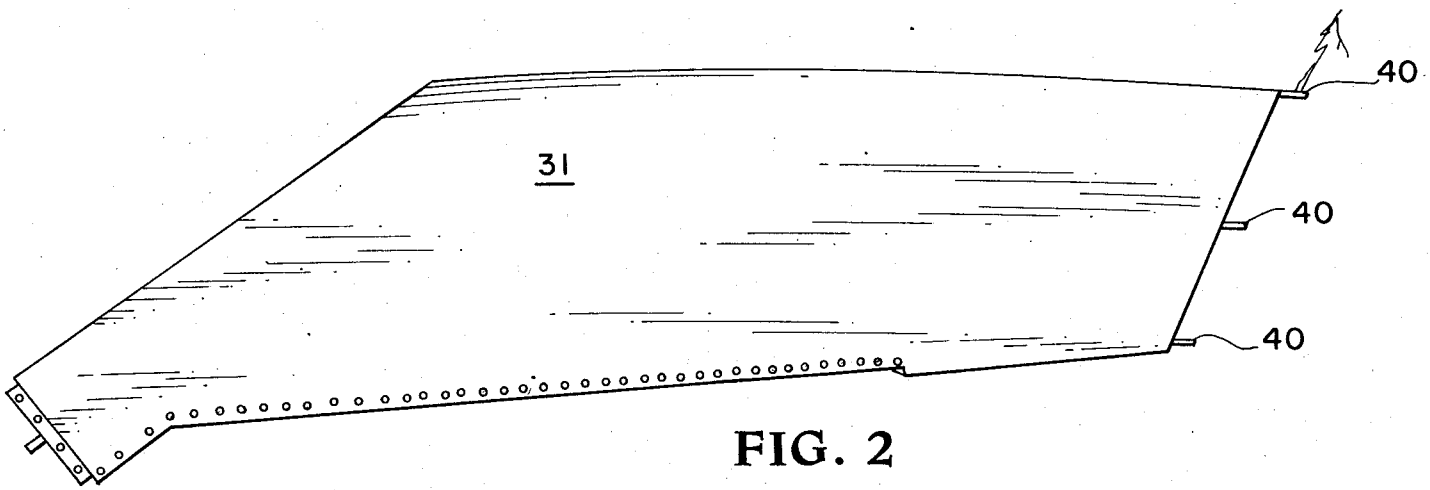
FIG. 2 is a side view of the vertical fin cap of the aircraft of FIG. 1 showing the present invention.

The lightning protection rods 40 are operatively spaced on trailing edges of aircraft 10 so that protection is spread on all trailing sections of the aircraft as shown in FIG. 2. FIG. 2 illustrates a vertical fin cap 31 constructed from carbon matrix material with three lightning protection rods 40 attached to the trailing edge. It should be noted that any material may be used to construct the aircraft surfaces and the present invention imparts protection to organic composite surfaces as well as metallic ones.

The lightning protection rods 40 may be constructed from any composite material having conductive fibers axially placed within the matrix. The material tested by the National Aeronautics and Space Administration, Langley, was a material commercially available from: Hercules Incorporated, called Magnamite-AS4/3502. This product utilizes a undirectional tape to insure alignment of the fibers axially. Magnamite-AS4/3502 is widely utilized in the construction of aircraft flight and control surfaces and was the material used in the vertical fin cap 31 for testing of the present invention. This composite material is an amine cured epoxy resin reinforced with undirectional graphite fiber tape. These AS4 graphite fibers are high strength filaments that have been surface treated to increase the composite shear and transverse tensile strength. Another material that can be employed in making the lightning protection rode of the present invention and in the same epoxy resin family, is Narmco 5200-GD, a Narmco woven cloth material also available commercially.

Figure 3:
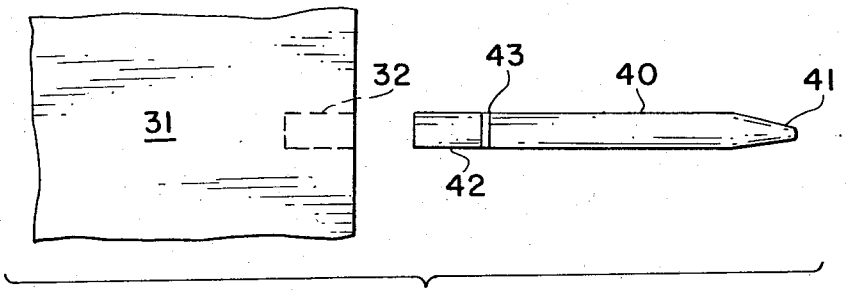
FIG. 3 is an expanded view of the vertical fin cap of FIG. 2 revealing the present invention and the manner of attachment to the vertical fin cap.

Lightning protection rods 40 may be produced from other materials which are conductive in the axial direction of the rod depending upon application. The protection rods 40 may also be in various shapes and sizes depending upon the size and type aircraft utilizing them. The protection rods 40 constructed and tested by the National Aeronautics and Space Administration in the F106 test aircraft were five and one-half inches long and five-sixteenths inch diameter. These protection rods 40 were tapered gradually and linearly along the last inch to approximately 50% of the major diameter at the tip to provide aerodynamic and esthetic properties, numeral 41 as shown in FIG. 3.

The lightning protection rods were attached to the trailing edges of aircraft 10 by drilling installment holes 32 approximately one inch in depth with an inside diameter corresponding to the outside diameter of protection rods 40, in this case five-sixteenths inch. The tolerances of the inside diameter of the installment holes 32 should be close enough to provide a firm fit physically with protection rods 40. This ensures a good electrically conductive bond between rods 40 and the aircraft surfaces.

To ensure a firm attachment of protection rod 40 to the vertical fin cap 31 a liquid epoxy was applied to the outside of protection rod 40 covering a band 43 approximately one-fourth inch wide, and spaced approximately three-quarter inch from the flat end of the rod. Care should be taken so as not to apply the epoxy to the first three-quarter inch of rod 40 to avoid interfering with the electrical bond between rod 40 and the vertical fin cap 31. Any high strength adhesive may be used for affixing protection rod 40 to the aircraft surface and Devcon® five minute epoxy was used for testing the invention. Devcon® is a superfast, clear liquid epoxy adhesive which bonds with a thin film and at low temperatures. Devcon® epoxy may be procured commercially from Devcon Corporation in Danvers, Mass.

The length of the rods may be varied and the longer the rod the more lightening strikes it will withstand without losing the ability to protect the aircraft. The rods are sacrificial and a small portion of the rod is usually atomized with each lightening strike. The disintegrated material is the most aftward part of the device and several strikes can be sustained with each rod before the total length is sacrificed and the protection abates. The rods tested at National Aeronautics and Space Administration Langley sustained as many as twenty strikes without losing the ability to protect the aircraft. The tested rods were approximately 5½ inches in length.

These protection rods are inexpensive to manufacture and can be easily replaced when sacrificed by drilling out the remainder of the old rod and installing a new one as described above.

Numerous variations and modifications of the invention will be readily apparent to those skilled in the art in the light of the above teachings. Thus, within the scope of the appended claims, the invention may be practiced other than as specifically described herein.

What is claimed as new and desired to be secured by Letters Patent of the United States is:

1. A lightning protection system for in-atmosphere vehicles having an aerodynamic surface thereon comprising:

at least one electrically conductive member affixed to and extending rearward from the trailing edge of said aerodynamic surface of the vehicle.

said electrically conductive member being in the form of a rod constructed of a material having a conductivity slightly greater than said aerodynamic surfaces;

said rod having a uniform diameter along a major portion of the length thereof, a tapered tip at the aft end, and being affixed to said aerodynamic surface such that an electrically contact surface between the rod and the surface extends for approximately three rod diameters; and means for securing said rod to said aerodynamic surface;

whereby a sacrificial lightning protection system is formed wherein said rod will provide a preferred conductive path and will dissipate the restrike energy through atomization of said rod.

2. A sacrificial lightning protection system of claim 1 wherein said rod is constructed of graphite-epoxy composite material.

3. A lightning protection system of claim 2 wherein the graphite in the graphite-epoxy composite material is longitudinally disposed fibers embedded in an epoxy matrix.

4. A lightning protection system of claim 1 wherein said aerodynamic surface is a vertical fin cap of an aircraft.

5. A lightning protection system of claim 1 wherein said aerodynamic surface is fabricated from metal and said electrically conductive member is comprised of metal matrix composite material.

6. A lightning protection system of claim 5 wherein said electrically conductive member is a rod of uniform diameter over a major portion of the length thereof and is provided with a gradual and linear taper along a minor portion toward the exposed aft tip, such tip having a diameter approximately one-half the diameter of the uniform portion.

7. A lightning protection system of claim 1 wherein the means for securing said conductive rod within the vehicle aerodynamic surfaces comprises an epoxy adhesive bonding over a minor area of the electrically conductive rod forward end that is received within the trailing edge of the aerodynamic surface, with the remaining area thereof being retained in electrical contact with said surface.

* * * * *